US010513279B2

(12) United States Patent
Mulligan

(10) Patent No.: US 10,513,279 B2
(45) Date of Patent: Dec. 24, 2019

(54) CONDITION BASED MAINTENANCE OF RAILCAR ROLLER BEARINGS USING PREDICTIVE WAYSIDE ALERTS BASED ON ACOUSTIC BEARING DETECTOR MEASUREMENTS

(71) Applicant: CANADIAN PACIFIC RAILWAY COMPANY, Calgary (CA)

(72) Inventor: Kyle Ryan Mulligan, Calgary (CA)

(73) Assignee: CANADIAN PACIFIC RAILWAY COMPANY, Calgary (CA)

( * ) Notice: Subject to any disclaimer, the term of this patent is extended or adjusted under 35 U.S.C. 154(b) by 229 days.

(21) Appl. No.: 15/691,589

(22) Filed: Aug. 30, 2017

(65) Prior Publication Data

US 2018/0273066 A1 Sep. 27, 2018

Related U.S. Application Data

(60) Provisional application No. 62/476,057, filed on Mar. 24, 2017.

(51) Int. Cl.
*B61L 27/00* (2006.01)
*B61K 9/12* (2006.01)

(52) U.S. Cl.
CPC ..... *B61L 27/0088* (2013.01); *B61K 9/12* (2013.01)

(58) Field of Classification Search
CPC ..... B61L 27/0088
See application file for complete search history.

(56) References Cited

U.S. PATENT DOCUMENTS 10,007,675 B2 * 6/2018 Marti ..... G06F 16/2365
2002/0072833 A1 * 6/2002 Gray ..... B61L 15/0081 701/19
2004/0167686 A1 * 8/2004 Baker ..... B61L 23/00 701/19

(Continued)

OTHER PUBLICATIONS

AAR, 2015. Manual of Standards and Recommended Practices—Section F/G, s.I.: Association of American Railroads.

(Continued)

*Primary Examiner* — Jason C Smith
(74) *Attorney, Agent, or Firm* — Bennett Jones LLP

(57) ABSTRACT

The invention provides an alarm comprising: (i) a plurality of trackside sensors with known locations each sensor to measure at least one characteristic of each railcar wheelset as it passes that sensor's location; (ii) an information store to receive, store and later provide the railcar wheelset characteristics measured by the track-side sensors; (iii) a preset or predetermined trigger pattern of wheelset characteristics associated with wheelset failure or some other railcar condition requiring alarm or notification action; and (iv) a comparator to compare historical measured characteristics about a particular wheelset from the information store to the trigger pattern. The alarm is triggered responsive to a comparator indication of a suitable match between chronologically contiguous historical measured characteristics about a particular wheelset in the information store with the trigger pattern. The alarm may be used to guide preventive maintenance and logistics, railway and railcar safety, or operation of the railcar or way.

10 Claims, 11 Drawing Sheets

WHEEL IMPACT LOAD DETECTOR

(56) References Cited

U.S. PATENT DOCUMENTS

| | | | | |
|---|---|---|---|---|
| 2014/0312179 | A1* | 10/2014 | Chen | B61L 15/0027 246/169 D |
| 2018/0154913 | A1* | 6/2018 | Saunders | G01R 31/343 |
| 2018/0273066 | A1* | 9/2018 | Mulligan | B61L 27/0088 |
| 2018/0299301 | A1* | 10/2018 | Raghavan | G01D 5/35351 |

OTHER PUBLICATIONS

Anderson, G. B., 2003. TD-03-009: Roller Bearing Inspections Based on Acoustic Detector Removals, s.I.: Transportation Technology Centre Inc. (TTCI).

Cummings, S. & Tournay, H., 2003. TD-03-028: Sophisticated Alarming Potential of Hot Box Detectors, s.I.: Transportation Technology Centre Inc. (TTCI).

Kankar, P. K., Sharma, S. C. & Harsha, S. P., 2011. Fault diagnosis of ball bearings using machine learning methods. Expert Systems with Applications, 38(3), pp. 1876-1886.

Ngigi, R. W., Pislaru, C., Ball, A. & Gu, F., 2012. Modern techniques for condition monitoring of railway vehicle dynamics. Journal of Physics: Conference Series, 364(1), pp. 1-12.

Pinney, C. & Cakdi, D., 2015. MD-11 Statistics—Failure Progression Mode (FPM) Analysis, s.I.: Transportation Technology Center Inc. (TTCI).

Shives, T. R. & Willard, W. A., 1977. MFPG Detection, Diagnosis and Prognosis. Chicago, Il, Proceedings of the 26th Meeting of the Mechanical Failures Prevention Group.

Walker, R., Cline, J., Smith, E. & Dasher, J., 2007. TD-07-024: Acoustic Bearing Detectors and Bearing Failures, s.I.: Transportation Technology Centre Inc. (TTCI).

* cited by examiner

Sites selected based on: proximity to interchange locations, neighboring maintenance facility equipment and resources, maximum traffic capture, ease of access.

PRINCIPLE OF OPERATION AND LOCATIONS

Flange Defects (Thickness - CP527616)

WHEEL PROFILE DETECTOR

ACOUSTIC BEARING PREDICTIVE MONITORING

TADS - ACOUSTIC BEARING DETECTOR

1. Maximum equipment utilization before failure: Trending BOI service interruption reduction of 95%.

2. Improved equipment health: Fleet BOEs have reduced by 65%.

TRENDING ENHANCEMENTS & ACOUSTIC INTEGRATION PERFORMANCE

ENHANCEMENT RESULTS on BEARINGS

- Automatic recognition of good vs. bad temperature scan profiles.
- Alert suppression for bad temperature scans and automatic ES technician deployment

HBD WAVE FORM SIGNATURE

Chart 1 - Warm bearing trending rule examples. Illustration of the Absolute 5, Delta 3, and Delta 5 warm bearing trending algorithms.

$$MTTF = 100.08e^{-0.135(\#\ growlers)}$$

Chart 2. Empirical relationship between the acoustic growler alert count and Mean Time to Failure (MTTF) for bearings (•) with exponential curve (—) Eq. 2 and safety factor (----) Eq. 3 curve fits.

*MAP 1. Illustration of the CP captive coal loop indicating the location of an Acoustic Bearing Detector (ABD) measuring all railcars on the loaded west-bound movement.*

*Graph 1. Time-frequency maps for a good bearing (a) and a bearing with a growler defect (b).*

*Chart 3. Empirical relationship between the acoustic growler alert count and Mean Time to Failure (MTTF) for bearings (•) with exponential curve (–)Eq. 2 and safety factor (---) Eq. 3 curve fits.*

CONDITION BASED MAINTENANCE OF RAILCAR ROLLER BEARINGS USING PREDICTIVE WAYSIDE ALERTS BASED ON ACOUSTIC BEARING DETECTOR MEASUREMENTS

FIELD OF THE INVENTION

This invention relates to measurements taken of rail, wheel and car state and behavior while in motion traversing a segment of a railway, and the use of that information to provide indications of different types of anomalies which are useful in predicting failure of car, wheel, bearing or truck or other components in the railway environment. The system allows for compilation of wheel and car componentry state and behavior information over time, correlation with failure and maintenance and post-repair analyses of the associated equipment, and thus for an adaptive or learning system which can become more accurate in predicting failure events to avoid their occurrence while minimizing unnecessarily early preventive maintenance, as well as avoiding failures or maintenance requirements which interrupt efficient and safe operation of the way, or cause damage to equipment or unsafe conditions. Methods of enhancing related sensor information and avoiding false readings are also provided.

BACKGROUND OF THE INVENTION

Preventive maintenance systems are known, with schedules based upon usage or some other parameter. Examples abound, but recommended maintenance intervals based upon mileage for a road vehicle are an example.

Failure detection systems are known, such as vehicle-based wear sensors, wear patterns in road tires, and the like. These systems provide some early warning or cause a reaction, such as a warning light or indication that maintenance is required. In some cases, such as overheating an engine, the engine itself may tip into 'limp mode' to avoid damaging itself by continuing in a degraded form of normal operational mode while lacking cooling or lubricating means (for example).

These systems are largely vehicle-based systems, or rely upon vehicle operating histories and are manually operated (odometer, Hobbs meter readings).

SUMMARY OF THE INVENTION

The invention provides an alarm comprising:

(a) a plurality of trackside sensors with known locations each sensor to measure at least one characteristic of each railcar wheelset as it passes that sensor's location;

(b) an information store to receive, store and later provide the railcar wheelset characteristics measured by the trackside sensors;

(c) a preset or predetermined trigger pattern of wheelset characteristics;

(d) a comparator to compare historical measured characteristics about a particular wheelset from the information store to the trigger pattern;

the alarm capable of being triggered responsive to a comparator indication of a suitable match between chronologically contiguous historical measured characteristics about a particular wheelset in the information store with the trigger pattern.

In another embodiment, in the alarm, the trigger pattern is derived from sensed wheelset characteristics about relevant railcar wheelsets correlated with historical failure-related information.

The trigger pattern of the alarm may, in an embodiment, be associated with information about a proximity derived from the trigger pattern and historical wheelset failure information, and the proximity may be relatable to a railcar service expectation such as distance from a sensor measurement which culminates in a trigger pattern match until failure of the railcar's wheelset, and the trigger pattern and proximity information may be referred to as a failure precursor.

The trigger pattern may be derived from sensed wheelset characteristics about railcar wheelsets correlated with a railcar state such as load imbalance, overload, or unexpected load.

The alarm may include or be coupled with an indicator to the alarm recipient of a consequential action, which may include a maintenance or logistic scheduling event, a charge to a railcar or load owner or operator, or an order or warning that the railcar will become unserviceable or should be removed from service prior to the expiry of the derived and alarmed proximity.

The comparator, being an essential element, is also, as an essential condition, a suitably configured computing device.

In an embodiment of the alarm, the identification of each wheelset with a particular railcar's axle and side may be done by correlating the measurement and location information with other relevant information which may include any of: information about railway, railcar, train consist, movement and scheduling, load, logistics, availability of maintenance or other services, billing, ownership, lading or other railcar or manifest, consist or ownership or operatorship information.

The invention provides, in an embodiment, a system to provide operator information to an operator of a railcar useful to the operator, the system including sensor apparatus comprising at least one of:

(a) A temperature sensor or Hot Box Detector ("HBD") aimed at the space through which a wheel of a railcar will pass while traversing a segment of the rail of a railway with which the temperature sensor is associated, to detect, measure/record the temperature of the wheel via a HBD-Wheel Temperature Detector ("HBD-WTD") or the bearings via a HBD-Bearing Temperature Detector ("HBD-BTD") at a spot from which the temperature of the bearings for the wheel may be easily inferred or determined, as the wheel passes by the space;

(b) An array of strain gauge type sensors called a Wheel Impact Load Detector ("WILD") along a segment of rail of a railway to measure wheel impact and load as a railcar's wheels traverse the segment of railway;

(c) A Wheel Profile Detector ("WPD") sensor, comprising:

(i) A laser or similar controlled energy source;

(ii) A camera or similar energy detector;

(iii) In a mounting device for attachment next to a rail of a railway and aimed to illuminate and capture profile details of wheels passing by the device on the rail;

(d) An acoustic bearing detector or Trackside Acoustic Detector System ("TADS"), comprising: a microphone or vibration sensor pack operatively attached to or near a rail of a railway, to capture/detect and measure/record vibration or sound made by each wheel of a railcar passing by the device on the rail;

These sensors are accompanied by associated timing, electronics and storage and/or transmission apparatus to collect the measurements acquired by the sensors in a format useful for analysis;

(e) information receipt, storage and manipulation means to receive information from the sensor means ('sensor information') about a wheel passing the sensor means (a 'sensed event') including sensed information, sensor location or identification information from which location may be inferred, and sensed event timing information for each sensed event;

(f) means to organize and correlate the sensor information and associate relevant parts of the sensor information with a particular wheel or railcar at a particular time and location;

(g) means to organize the sensor information associated with a particular wheel or railcar over time ('particularized sensor information over time'), and to provide both statistical (mathematically derived) and graphical models portraying that organized sensor information;

(h) means to determine, whether preset by the operator or the operator's policies, or by cross-referencing particularized sensor information over time against proven or deemed failure of the relevant wheel, that a subset of the particularized sensor information associated with proven or deemed failure of a relevant wheel is an indication of proven or deemed failure and imminence of failure (a "failure precursor");

(i) means to identify a particular element or elements of the particularized sensor information over time which are different from other elements of the particularized sensor information over time; and (j) means to provide the operator information, which may be an alert, to the operator that a particular wheel of a particular railcar is anomalous, and that the anomaly, being the difference in sensor information identified at step i) correlates meaningfully with the indication of step h) of a failure precursor, indicating that a particular maintenance or operational action is recommended, and may include in the failure precursor operator information an indication of remaining serviceable life of the particular wheel.

In another embodiment, the system provides that, IF the particularized sensor information over time or frequency is:

(a) from acoustic bearing sensor TADS information which indicates internal or external defects of individual railcar wheel roller bearing component such as, but not limited to: the bearing, cup, cone, roller, and cage; where the defects can include, but are not limited to: spalling, mechanical, water etch, bearing destroyed, and is a failure precursor—THEN the operator information or alert to the operator may be given opportunistically to schedule maintenance of the defects indicated to railcars already sent to a shop for maintenance or which can be scheduled at a next available maintenance facility in the railcar's routing;

(b) from acoustic bearing sensor TADS information which indicates internal and external individual railcar wheel roller bearing component defects such as, but not limited to: spalling, brinelling, and/or water etch, which are indicative of progressive internal defects known to lead to or predictive of high temperature failures, and is a failure precursor—THEN the operator information or alert is predictive and is used to schedule maintenance of the defective component by mechanical shops to perform proactive repairs at a convenient facility and time in the railcar's routing;

(c) from infrared temperature sensor HBD information and indicates internal and external individual railcar wheel roller bearing component defects such as, but not limited to: spalling, brinelling, mechanical, bearing destroyed and/or water etch, which are indicative of urgent internal defects and may be predictive of incipient complete bearing failure, and is a failure precursor—THEN the operator information or alert to the operator indicates that the affected railcar's wheel roller bearing is immediately failing and the train must cease movement for inspection and handling whether scheduled or not—this type of information or alert may be the type of particularized sensor information over time which comprises a failure precursor;

(d) and is from multiple infrared temperature sensor detectors HBDs and indicates internal and external individual railcar wheel roller bearing component defects such as, but not limited to: spalling, brinelling, mechanical, bearing destroyed, and/or water etch, which are indicative of urgent internal defects and progressing bearing failure, and is a failure precursor—THEN the operator information or alert to the operator is predictive that the affected railcar roller bearing is progressively failing and is used to schedule maintenance of the defective component by mechanical shops to perform proactive repairs at a convenient facility and time in the railcar's routing and that this must be handled at nearest mechanical accessible location;

(e) from infrared temperature sensor HBD information which indicates airbrake system component defects such as, but not limited to: brake beam, brake cylinder, brake side frame liner, brake rigging, brake control valve, or hand brake applied, which are indicative of railcar inoperative brake systems both from cold and hot sensed wheels, and is a failure precursor—THEN the operator information and alert to the operator is that the affected railcar wheel is experiencing excessive temperatures and the train must cease movement for inspection and handling whether scheduled or not—this type of information or alert may be the type of particularized sensor information over time which comprises a failure precursor;

(f) from infrared temperature sensor HBD information across multiple HBD detection systems and indicates airbrake system component defects such as, but not limited to: brake beam, brake cylinder, brake side frame liner, brake rigging, brake control valve or hand brake applied, which are indicative of railcar inoperative brake systems both from cold and hot sensed wheels, and is a failure precursor—THEN the operator information or alert to the operator may include that the affected railcar wheel is experiencing excessive temperatures and the train must apply and release airbrakes to minimize excessive temperatures;

(g) from WILD strain based sensor information and indicates a weight in pounds or kilograms or balance difference or ratio (%) between wheels of a railcar, and is a failure precursor—THEN the operator information or alert to the operator may be that the railcar's load is off-balance and should be re-balanced or, that surcharges, rerouting or other services or actions may be appropriate;

(h) from WILD strain based sensor information and indicates a load/empty difference or ratio (%) between train documentation and actual railcar contents, and is a failure precursor—THEN the operator information or alert to the operator is that the car's load is improperly documented or loaded, an undocumented load change has taken effect and the car and load should be reviewed at a next opportunity, and appropriate corrective activities and potential charges, documentation changes and similar actions should take place;

(i) from WILD strain based sensor information and indicates a wheel defect based on measured impact forces (KIPS or 1000 lbs-force) such as, but not limited to: shelling, out of round, or tread build-up, and is a failure precursor—THEN the operator information or alert to the operator is that the railcar's wheel may be condemnable at and must be replaced at a next or convenient time and location depending upon the severity of the defect indicated; or (j) from a WPD optical sensor information and indicates a wheel defect in inches or millimeters such as, but not limited to: thin or high flange, hollow tread, thin rim, out of gauge, or other feature sized between x-y coordinates in inches and millimeters of the measured profiles, and is a failure precursor—THEN the operator information or alert to the operator may be that the railcar's wheel is condemnable and must be replaced at a next or convenient time and location depending upon the severity of the defect indicated.

In a further embodiment, the system provides that the sensor location information, the railcar's route, and sensed event information is combined to determine or infer other information which is operator information and which is relevant to determination of a predicted term of use of the railcar and location or range until failure of the asset predicted by the failure precursor, such as distance traveled by the railcar's wheel; in particular:

(a) In railway operations utilizing the railcar which are a fixed circuit, a single sensor location may be sufficient to determine relevant information such as distance travelled by the railcar's wheel, although it may be preferable to utilize multiple sensor locations;

(b) In railway operations utilizing the railcar over routes which are not a fixed circuit, a multiplicity of sensor locations will be required, and the co-ordination of sensor, railcar, train consist and routing and load information from a variety of different railway and train operations or even operators may also be required in order that failure precursor and relevant operator information and alerts may be provided by the system.

In another embodiment, the quality of sensor information can be improved by statistically analyzing waveforms of the information provided by a sensor which includes information about sensed events, and discarding sensor information the waveform of which is not statistically representative of true sensed events.

Further, the quality of sensor information collected from HBD sensors may in particular be susceptible to sending information appearing to be from sensed events, or which may be triggered by a sensed event, but the information sent may be degraded or distorted by extraneous influences such as sunlight on a housing of a temperature sensor; by statistically analyzing a large number of sensed event information elements to derive an expected waveform profile of good information from sensed events, it is possible to flag information about particular sensed events which is anomalous in comparison to the derived expected waveforms and cause the flagged sensed event information to be treated differently, for instance to require manual review of the information or to apply a factor to the weighting of the anomalous sensed event for use in operation of the system's other subsystems.

In yet another embodiment, the system of the invention can be adjusted during operation, particularly comparing inspection and repair information from repair facilities and activities against the failure precursor information, to continuously improve the system's operation; additional data sources may also be used to generate better failure precursor information; statistical analysis of many pieces of particularized sensor information over time or frequency from a large variety of sensors and sensor types about a large variety of railcars, loads, wheels and related sensed equipment may also be used to generate meaningful multi-variate or combined sensed event information which together may form failure precursor or similar predictive information for the operator.

Another embodiment provides that the failure precursor subset of information may be sensed event information from a variety of sensor types and may be from a variety of sensor locations.

Other embodiments are also described, as examples and not as limitations to the ideas at the base of the invention, and the invention's essential elements. The invention is defined and limited by the claims.

DESCRIPTION OF THE TABLES, CHARTS AND GRAPHS

TABLE 1 Sensor Types and Descriptions
TABLE 2 MTTF Analysis Example Results
TABLE 3 Experimental Results of MTTF in days for test cases
TABLE 4 Service Avoidance Results of Use of Failure Precursor Information (TTF)
TABLE 5 Bearing Teardown Results
Equation 1 Predicting TTF By Acoustic Growler Count
Equation 2 Equation of a Fitted Curve to TTF
Equation 3 MTTF with Safety Factor from #Growlers

DETAILED DESCRIPTION OF THE INVENTION

Figure 1:
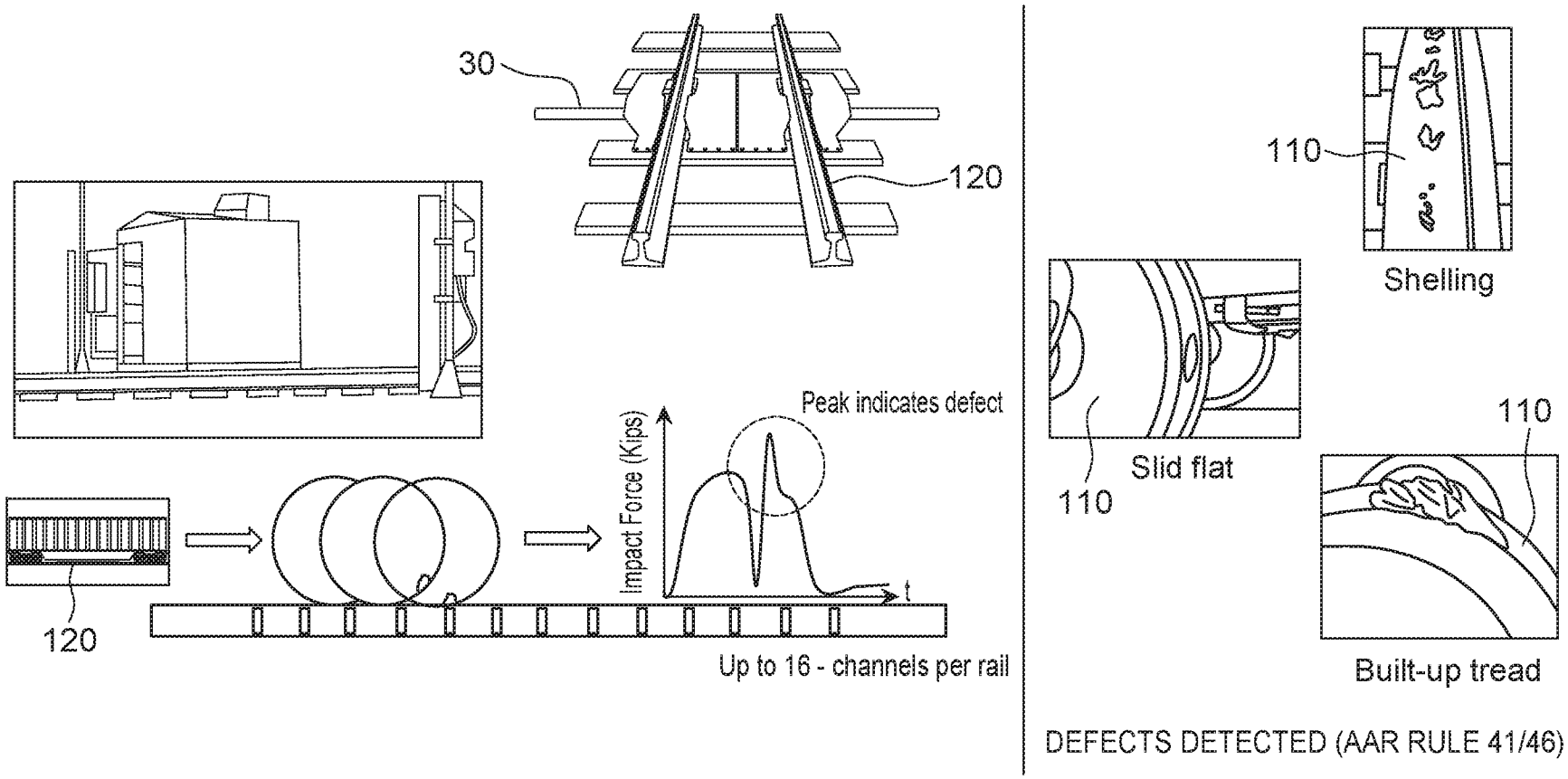
FIG. 1 Wheel Impact Load Detector and specifically the principles and defects detected FIG. 2 Wheel Impact Load Detector and specifically the overload/imbalance/waybill errors FIG. 3 Wheel Profile Detector and specifically the principle of operation and locations FIG. 4 TADS—Acoustic Bearing Detector and specifically acoustic bearing predictive monitor FIG. 5 Enhancement Results on Bearings and specifically trending enhancements and acoustic integration performance FIG. 6 HBD wave form signature FIG. 7 "Chart 1" Warm bearing trending rule examples FIG. 8 "Chart 2" Chart showing relationship between growler alert count and MTTF FIG. 9 "MAP 1" Provides an illustration of the CP Coal Circuit route FIG. 10 "GRAPH 1" Time frequency maps FIG. 11 "Chart 3" Graphic chart of TTF, being MTTF and Safety Factor Glossary Provides a glossary of certain defined terms
Figure 2:
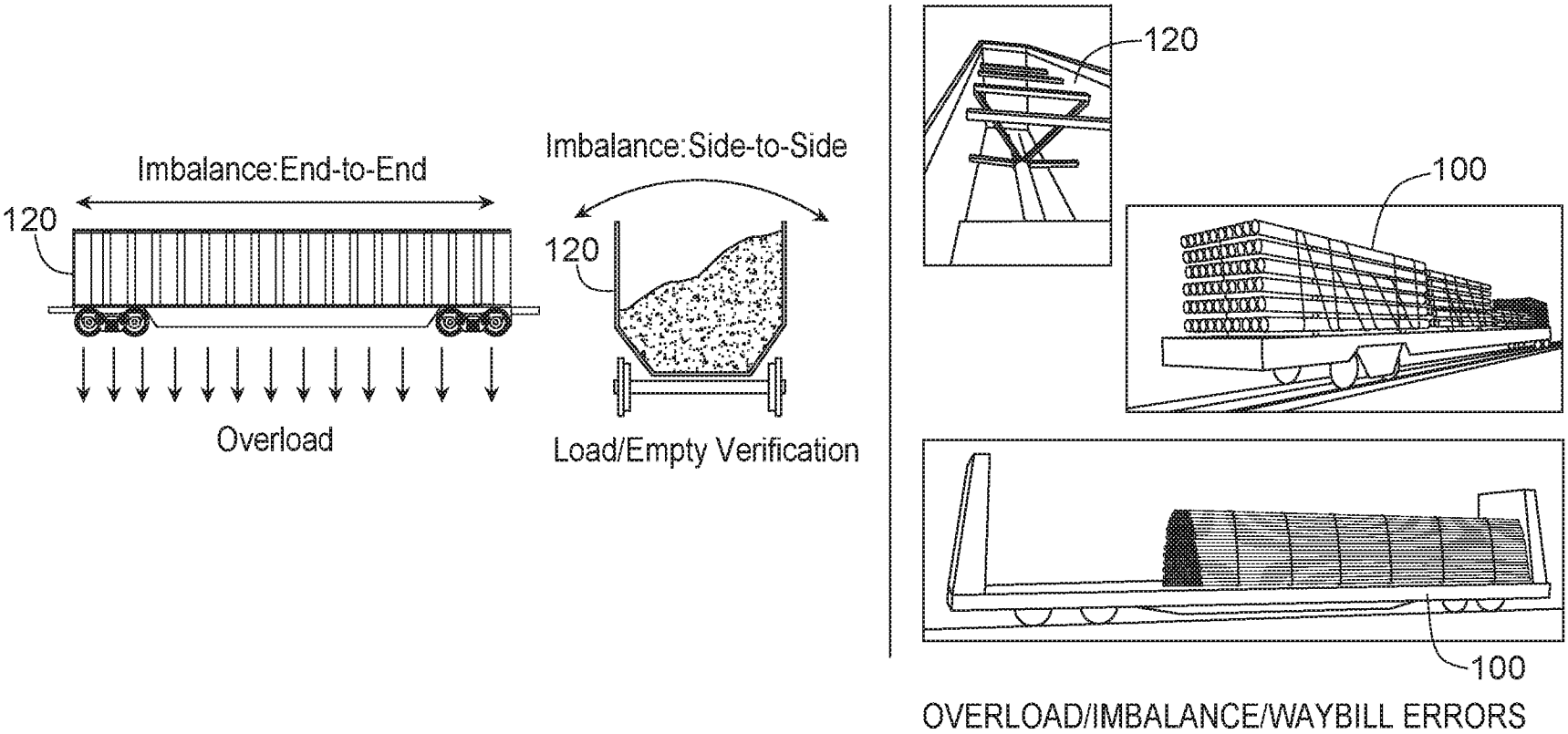
Figure 3:
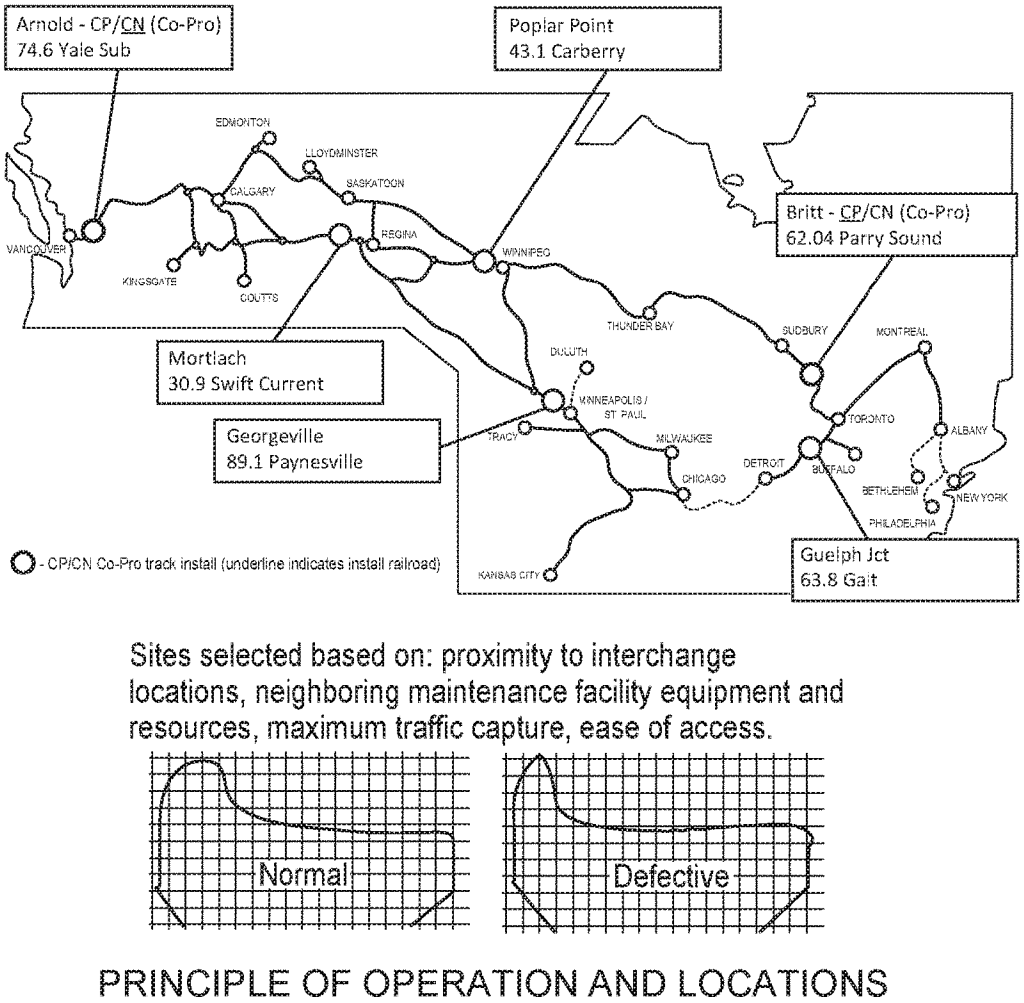
Figure 3:
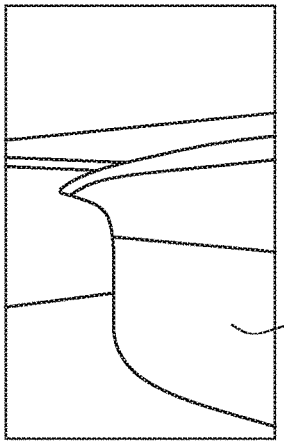
Figure 3:
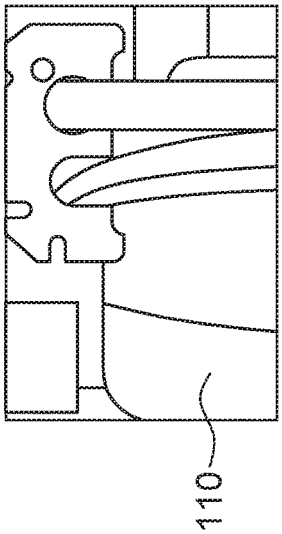
Figure 4:
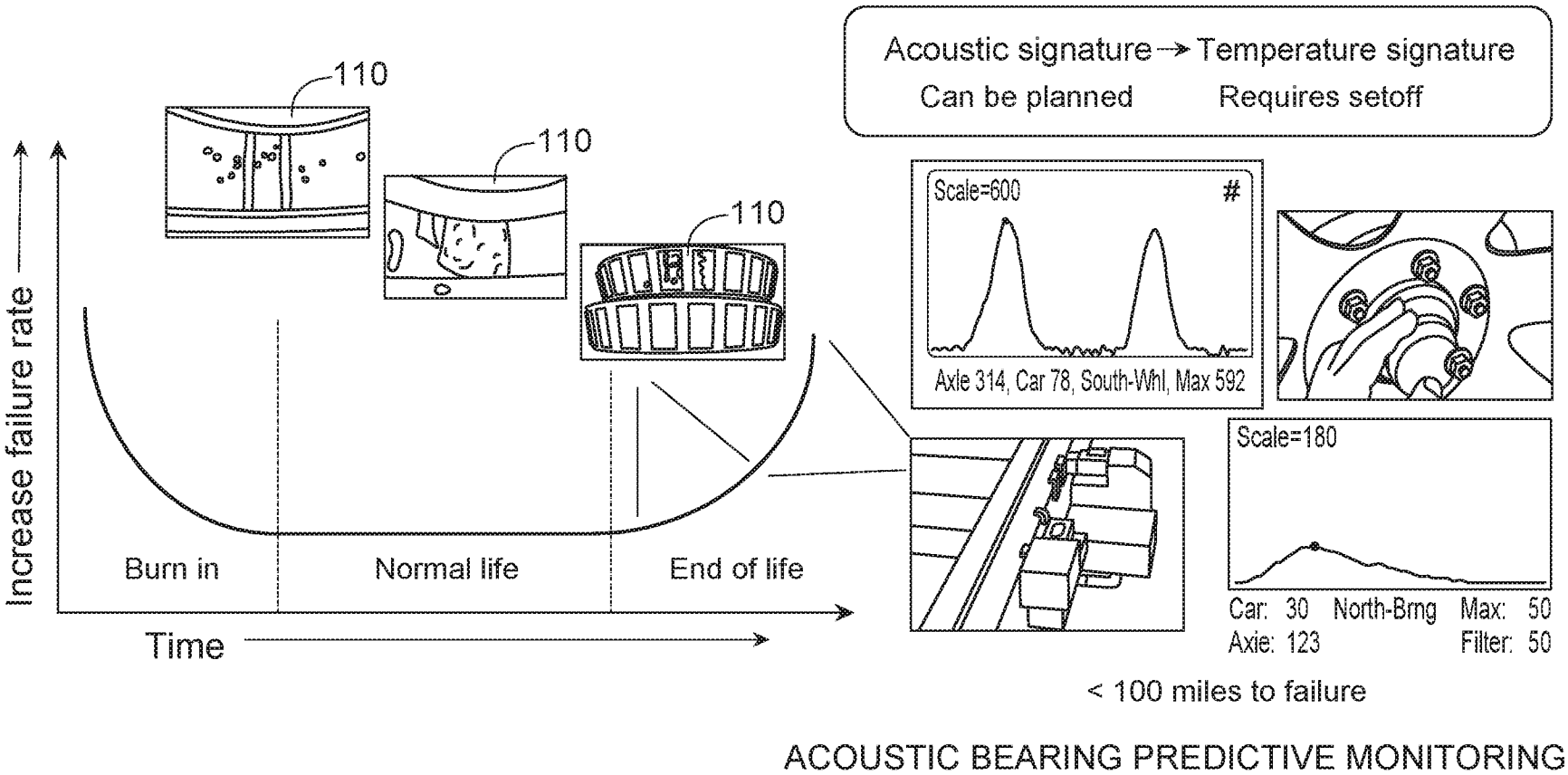
Figure 5:
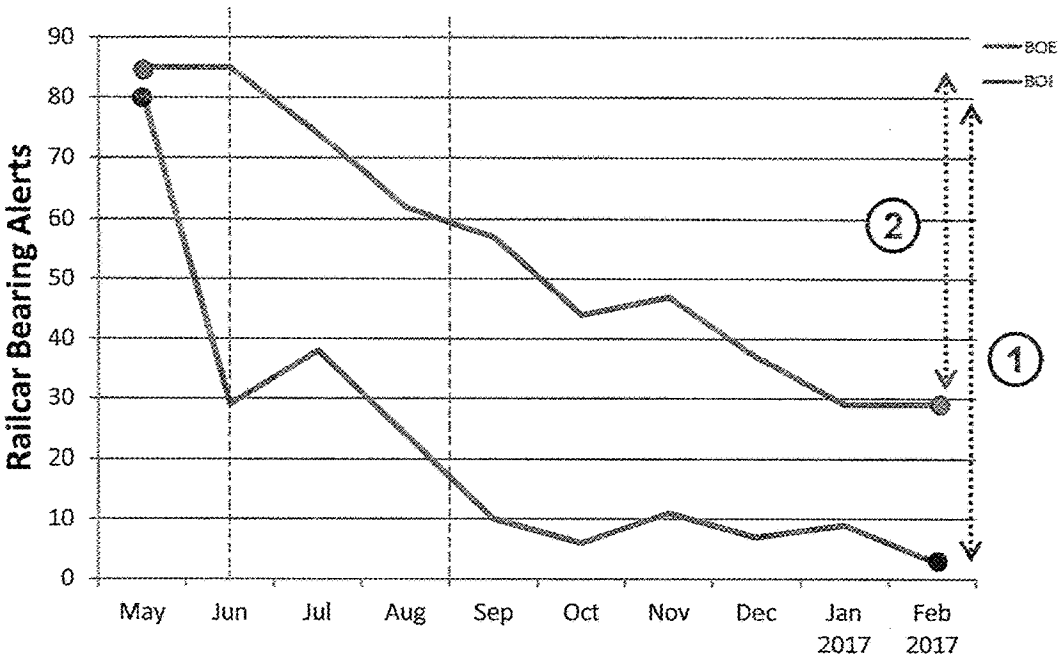
Figure 6:
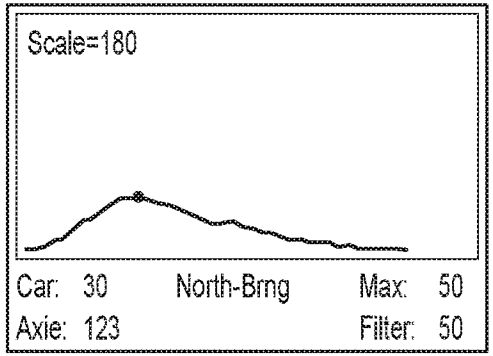
Figure 6:
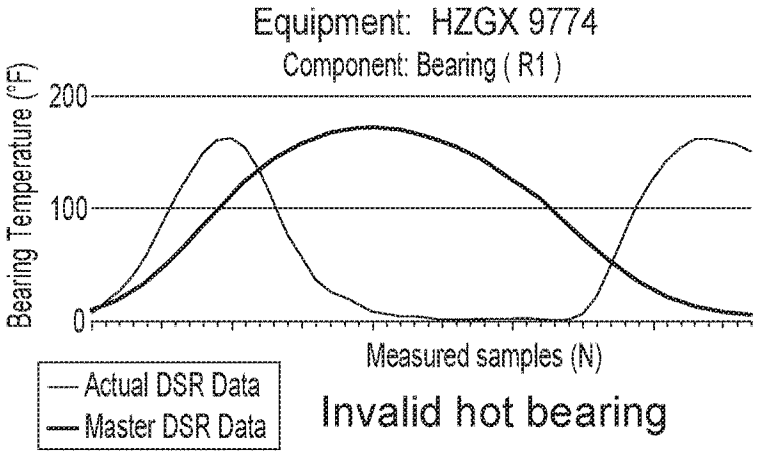
Figure 6:
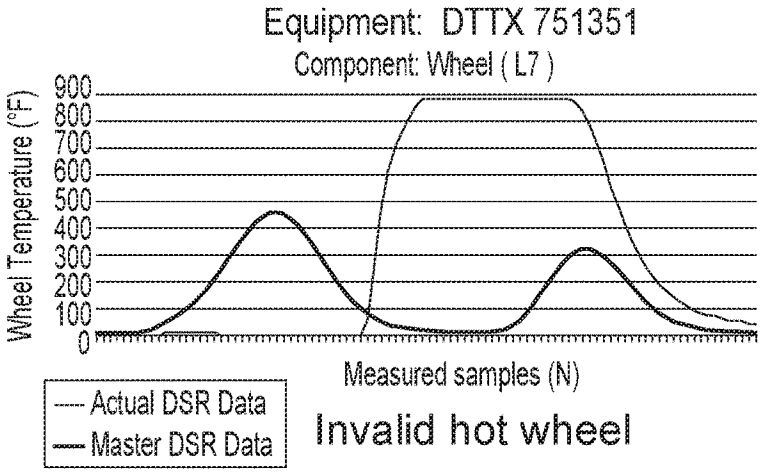

The implementation of warm bearing trending in the rail industry, using bearing temperature wayside detection systems, has played a key role in reducing train derailments caused by overheated roller bearings. Although the implementation of this technology greatly reduces risks during train movements, occurrences of warm bearing trending alerts, identified by excessive heat signatures that are indicative of the end of a bearing life cycle, have conventionally required immediate railcar setoffs en-route. These setoffs lead to significant service interruptions and undesired costs. The introduction and increasing adoption by Class I railroads of acoustic bearing wayside detection systems has enabled better insight into the bearing failure process. This application describes a technique to improve service within, for example, a coal rail fleet by modelling acoustic data to predict the number of trips until predicted failure of railcar roller bearings. This prediction method allows proactive maintenance to be performed prior to a failure thereby reducing railcar setoffs. Other benefits and similar sensor and data-enabled analytics are described and claimed, aimed at enhancing a rail operator's operations.

Wayside detectors are established sites at fixed locations within the rail network. In the inventor's work on this subject at Canadian Pacific Railway Corporation Company ("CP") CP, 5 different wayside detection systems exist: Wheel Impact Load Detector (WILD), Hot Box Detector (HBD), Trackside Acoustic Detector System (TADS), and Wheel Profile Detector (WPD). The HBD consists of two detectors: Bearing Temperature Detector (BTD) and Wheel Temperature Detector (WTD). The sensing technology of the BTD and the WTD is the same but the sensors are oriented differently and scan different surfaces. All of CP's HBD systems are configured with co-located BTD's and WTD's. Table I describes each detection system and the primary measurement parameter they are designed to acquire.

TABLE 1

SENSOR DESCRIPTIONS

| Detector | Description | Measurement parameter |
|---|---|---|
| WILD | A series of electronic strain gauges mounted to the rail web. Designed to identify wheel geometrical defects which have a probability to lead to wheel and/or rail failure. | Vertical and/or Lateral Force (KIPS) |
| HBD-BTD | A pyrometer sensing element mounted between rail cribs and oriented at a 45° angle from vertical to view passing railcar wheel bearings. | Temperature above ambient (° F.) |
| HBD-WTD | A pyrometer sensing element mounted between rail cribs and oriented laterally to view passing railcar wheel trend and faces. | Temperature above ambient (° F.) |
| TADS | A series of microphone sensing elements which form an array. The sensing elements are mounted laterally at the height of passing railcar wheel bearings. | Vibration amplitude (Volts) |
| WPD | A series of optical camera-based sensing elements which rely on laser excitation. Lasers are projected onto wheel surfaces and captured using the cameras. The surface profile of the wheel is measured. | Wheel profile points and dimensions (mm, inches) |

When deployed, each of the above detectors provide data relatable and relevant to a particular wheel on a particular individual axle and side of a particular railcar for all measured train passings.

Automated Equipment Identification ("AEI") systems such as those based on optical scans or radio frequency units can be used in conjunction with the sensors to infer wheel, truck, axle, side and car information from tags mounted on each railcar to assist in wheel and side identification. Other correlation methods can be used to link a measured sensed event at a location with a particular wheel and car. This information is used to correlate raw axle and side sensor information with individual wheel locations on a particular railcar, based on inferred railcar orientation within a consist being measured by the particular sensors passed.

AEI systems can be co-located with a detector or sensor, or the matching of sensor output and wheel can be performed virtually based on available AEI or similar consist information from another source or repository and mapped or correlated and associated with, sensor location, sensed event timing, and sensor reading. For virtual AEI, matching can be performed using any of, but not limited to: passing time, passing date, and number of axles and/or railcars in a train or consist.

Once the train consist is matched with AEI, additional operational databases can also be searched to assign the consist to a train ID. The train ID is used to perform trending analyses across multiple detector systems (mainly HBD) or multiple sensed events with respect to the same car and wheel, or the same consist.

Whether an AEI is co-located with a detector system or not, sensor data may be transmitted to a central office repository via, but not limited to: WiFi, Cellular, Satellite, or Fibre. If only raw sensor data are sent, both consist and train symbol matching are performed by correlation with virtual consist information. If the consist information is received with the sensor data e.g. from a co-located AEI site), only train symbol matching may need to be performed.

All matched data are stored and then evaluated using a rules engine. Sensor data may include at least: sensor identifier, time and date, and sensor reading when triggered (or may be done at a relatively continuous sample rate). Location and other data may also form part of the sensor data.

The rules engine contains a series of modelled conditions against which sensed events and sensed event histories for wheels in trains and/or railcars are evaluated in order to determine faults which may affect safety or performance.

Warm bearing trending analyses involve tracking a car in a consist related to a given train symbol across some number of sensors or detectors. CP generates three (3) types of warm bearing trending alerts based on HBD sequential detector data (Chart I). The alerts are labelled internally as:

Absolute 5, Delta 3, and Delta 5. Absolute 5 alerts are designed to detect consistently high absolute bearing temperatures and trigger when 3 out of 5 sequential bearing temperatures are measured above a fixed threshold (Min. Limit) from the same wheel. The Delta 3 and Delta 5 alarm types are designed to measure sudden and gradual bearing temperature increases and trigger when a differential ($\Delta T$) between the highest and lowest temperatures of a wheel are measured across 3 or 5 HBDs respectively. There is also a fixed minimum highest wheel temperature threshold requirement for the Delta 3 and Delta 5 alerts (Min. Limit).

Figure 7:
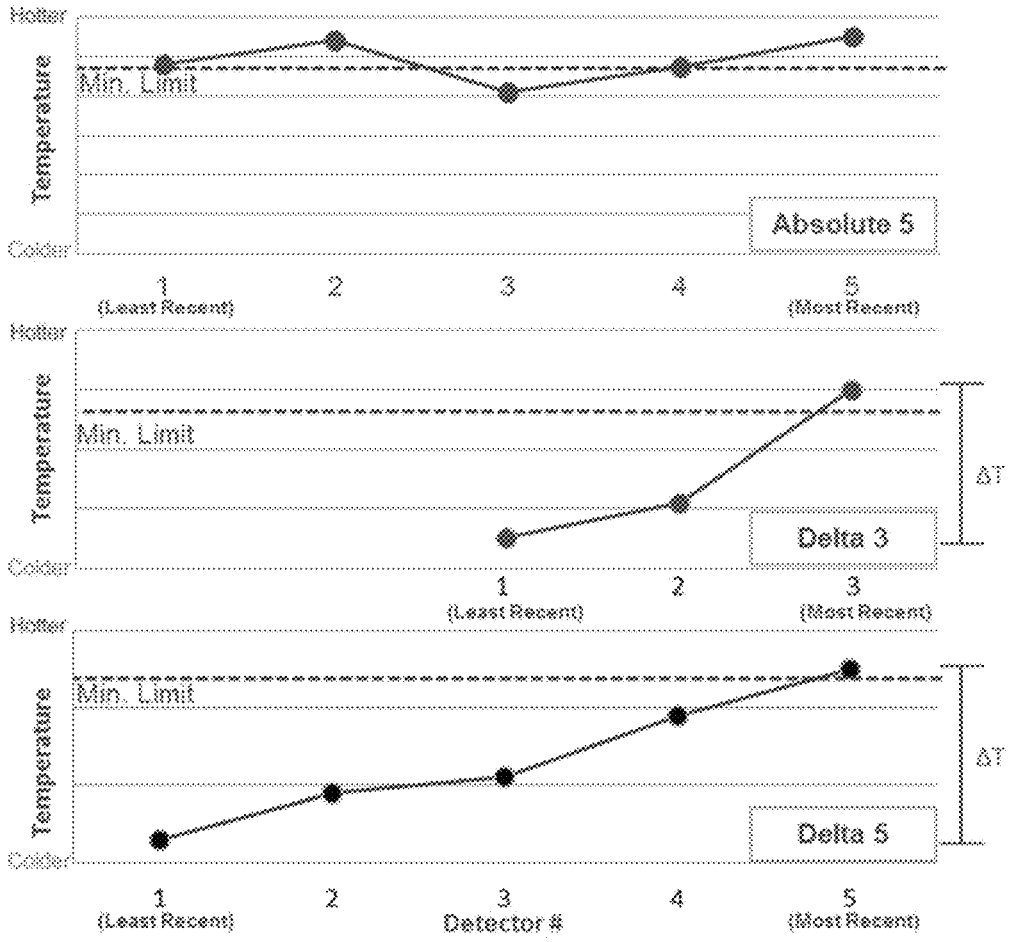

FIG. 7 (Chart 1) illustrates warm bearing trending rule examples.

In the prior art, when a railcar HBD reading triggers a trending alarm, an operations centre rail traffic controller is notified of the event as an exception (to normal). The exception is then stored in an exceptions database. The train crew of the train the consist of which includes the car with a wheel with an associated exception is immediately notified, which notification may include an instruction or informational element to trigger the crew to setoff the railcar on-line in a siding. Mechanical assistance is dispatched to repair the affected equipment. This can cause a service interruption for the train setting off the railcar, approaching and preceding trains, and the train and maintenance equipment required to 'lift' therepaired asset to effect the repair.

In an embodiment of this invention, for example, an acoustic bearing prediction rule uses a counter of the number of 'growler' alerts recorded with respect to a given bearing, wheel and railcar. A Mean Time to Failure ("MTTF") in number of trips or time to a preferred car maintenance endpoint is calculated based on a pre-defined table (Table 2). If a wheelset change occurs whether before or after an actual failure, the growler count is reset. If a new growler is received prior to a predicted failure point, the MTTF is updated based on the value in Table 2, even when the current MTTF is less than the table value. This is because as the growler count increases, the model's predictive accuracy also increases. This process allows the bearing to be used for additional service cycles before failure or repair for maximum utilization, when compared with prior methodologies.

Once the maximum number of trips or other MTTF measurement is reached, a Bad Order when Empty ("BOE") maintenance alert is indicated for the railcar and both railway operations and mechanical shops are notified. The affected railcar, in CP's system, cannot be reloaded until the affected bearing (associated wheelset) is changed. If at least 1 growler is reported but the MTTF has not been reached, an opportunistic maintenance alert can be applied in the event the railcar is sent to a repair track for another reason. Both the predictive BOE and opportunistic alerts prevent the HBD warm bearing trending alert occurrence which conventionally meant the wheelset or bearing failure was imminent, with associated relatively urgent service interruption, while obtaining maximum asset utilization.

TABLE 2

Results of the MTTF in trips based consolidating both development and test cases.

| # of Growlers | MTTF in trips before warm bearing trending alert |
|---|---|
| 1 | 15 |
| 2 | 12 |
| 3 | 10 |
| 4 | 8 |
| 5 | 7 |
| 6 | 5 |
| 7 | 4 |
| 8 | 3 |
| 9 | 2 |
| 10 | 2 |
| 11 | 2 |
| ≥ | BOE |

In the CP example, to build Table 2, stored growler and trending exceptions were compared. A sample of 30 railcars, each with a variable number of growlers was extracted from CP's historical detector archive. The time to failure ("TTF") in calendar days between the last received growler and the HBD trending exceptions were extracted. Some railcars had the same number of growlers but slightly different TTFs. In these cases, the TTF's were averaged. The average TTFs were plotted based on growler counts and the points were fitted to a decaying exponential (Chart 2).

Figure 8:
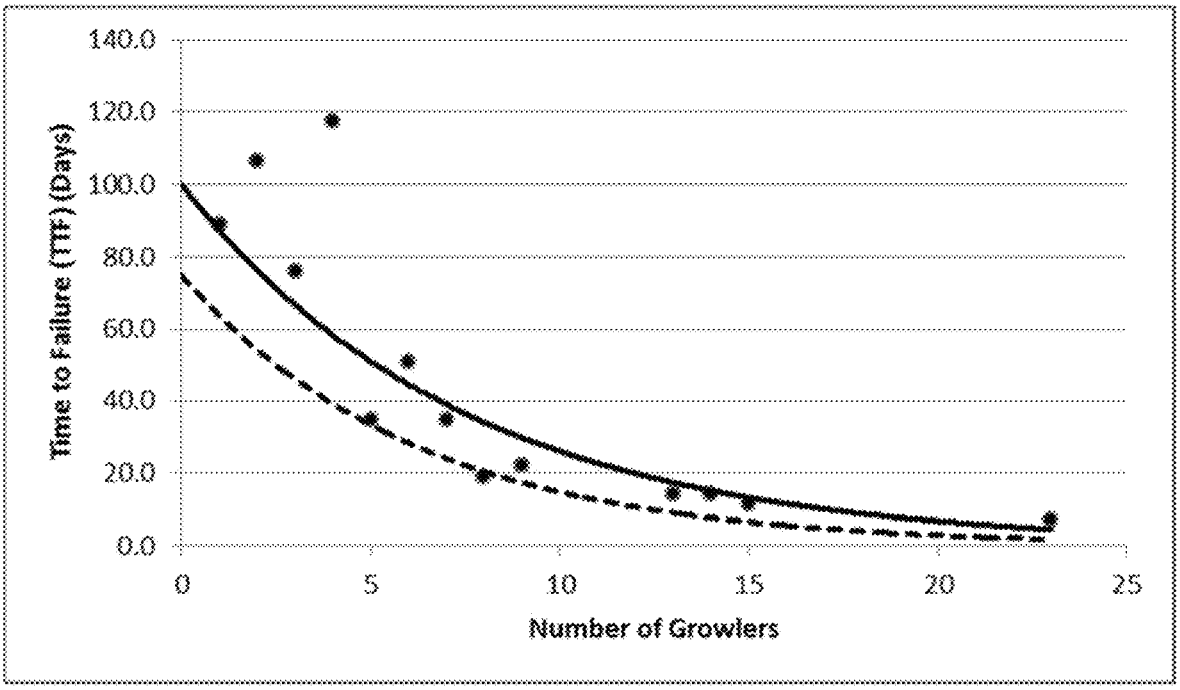

FIG. 8 (Chart 2) illustrates an empirical relationship between the acoustic growler alert count and Mean Time to Failure (MTTF) for bearings (•) with exponential curve (-) Eq. 2 and safety factor (---) Eq. 3 curve fits.

The Table is calculated using the fitted equation to the Chart 2 plot for increasing number of growlers. This Table is used to inform or construct a rules engine. It can be re-evaluated at any time based on model performance and experiential data.

Predicting in number of days to a maintenance event proved to be too fine for practical operations in the CP example. As a result, the number of trips between maintenance points for captive service and an average number of trips between maintenance point for non-captive service was calculated. The TTF was then converted into trips by dividing the equation in Chart 2 by the number of days per trip. This gives the result in Table 2. The number of trips to a maintenance endpoint would then be configured based on railcar type and service type (intermodal, bulk, manifest). The CP model has been applied to other CP fleets and car types.

Roller bearing failures may be identified by the occurrence of warm bearing trending failures following the triggering of an acoustic alert or a sequence of such TADS-based alerts. The application of this technique, based on 21 individual railcar events arising from open acoustic bearing 'growler' alerts, is outlined below. The results of this predictive model identified both a need and a means of meeting the need for maintenance that can be conducted during an empty cycle at a convenient time and locating, thus reducing or eliminating both setoffs and subsequent service interruptions. The predictive model, which may be embedded into a rail operation's Health Monitoring System, has demonstrated a significant (up to 91%) reduction in CP's example coal fleet monthly service interruptions.

The implementation of vast interconnected Hot Bearing Detector (HBD) networks by North American Class I freight railways (which is prior art to this invention) has enabled the development of elaborate warm bearing temperature trending algorithms (Pinney et al. 2002). These algorithms have been designed, based on historical data analysis, to proactively trigger alerts on failing railcar roller bearings in a moving train consist. These HBD high temperature alerts are used, depending on severity, to identify affected railcars for service such that 'over-the-road' failures, defined as requiring a setoff and associated service interruption, are reduced. The hot bearing alerts have been highly successful in reducing roller bearing related derailments due to burn-offs and are a vast improvement over prior absolute hot bearing alert systems which communicated from the detectors directly to the train crews and detected only the last portion of a bearing life cycle (Cummings & Tournay, 2003).

Although warm bearing trending algorithms provide some visibility of progressively failing roller bearings, often the bearing failures progress too rapidly, reaching critical temperature limits (greater than 180° F. above ambient), without much prior warning. Subsequent train movement at critical temperature limits has been shown to result in a roller bearing burn-off within an order of 100 miles unless action is taken (Shives & Willard, 1977). While bearing temperature trending algorithms are somewhat effective at preventing roller bearing burn-offs, algorithms with a high percentage of verified defects, as per MD-11 reports describing bearing failure progression modes (FPM) (AAR, 2015), typically result in identifying when a railcar must be setoff-with a degree of urgency (due to lack of prior warning) to avoid more severe failures. These incidents result in train stops not included in the train's operating plan, causing unplanned service interruptions and delays to other trains. This also impacts customer service with respect to both the affected railcar and load asset if it is loaded, in addition to all other assets in that train, thereby reducing the overall benefit of small or short-term pre-detections.

The Acoustic Bearing Detector ("ABD") sensors, designed to measure acoustic signatures, can observe early signs of failing railcar roller bearings prior to heat signature detection by HBDs. These ABD detection systems however have a high sensitivity to acoustic signature anomalies and in 55% of cases where an acoustic alert is triggered, a heat signature does not occur (Walker, et al., 2007). Consistently however, in over 90% of removals, ABD alerts result in verifiable MD-11 FPM equipment defects such as: spalling, mechanical, water etch, and bearing destroyed (Anderson, 2003). Although these defects are present in the majority of post-teardown cases, near term roller bearing failures resulting in railcar setoff requirements and associated service interruptions may not have immediately resulted, and would not realistically have been predicted with this (ABD) data alone.

In this invention, an exemplary analysis of the relationship between ABD and HBD alert data is disclosed, which is based on measurements from the CP captive coal fleet. The results of the analysis were used to develop a predictive system capable of identifying roller bearing failures in the coal fleet on the empty load cycle. Roller bearing failures were defined as an occurrence of a warm bearing trending alert. The predictive system demonstrates sufficient prior visibility for equipment fault detection to provide enough warning information to prevent a railcar setoff, thus providing essentially the entire benefits of pre-detection while enabling the roller bearing to run as close to failure as possible without actually failing catastrophically such that the fleet is not unnecessarily over-maintained. Since production implementation in confidential settings in August 2016, the system has reduced roller bearing related service interruptions in the CP coal fleet by 91% based on previous average monthly service interruptions reported.

The Canadian Pacific Captive Coal Fleet Example

The CP captive coal fleet originates and terminates in the Golden, BC yard. All trains are made up of 152 empty aluminum bathtub coal gondolas. These trains travel in a continuous loop which starts with trains travelling south from Golden and then east to be loaded near Fording, AB. Once loaded, the trains return to Golden and then proceed west to the Pacific Coast passing an ABD on the loaded movement as shown in Chart 1. Note that the ABD is located in dual track (not shown) and captures only westbound loaded trains.

The CP captive coal fleet example provides consistency in train make-up and detector read frequency due to the "closed loop" nature of the train and car movements. These operational consistencies allowed for a stable example environment by eliminating: railcar component, mileage, load and train handling variables in addition to enabling the gathering of constant repeatable acoustic measurements from bearings using the ABD. In addition to ABD measurements, temperature monitoring using HBD detectors spaced every 20-25 miles was also performed. This environment provided a benchmarking opportunity to develop predictive systems based on actual in-service and moderately controlled conditions which may then be progressively expanded or generalized to other fleet and circuit types.

Figure 9:
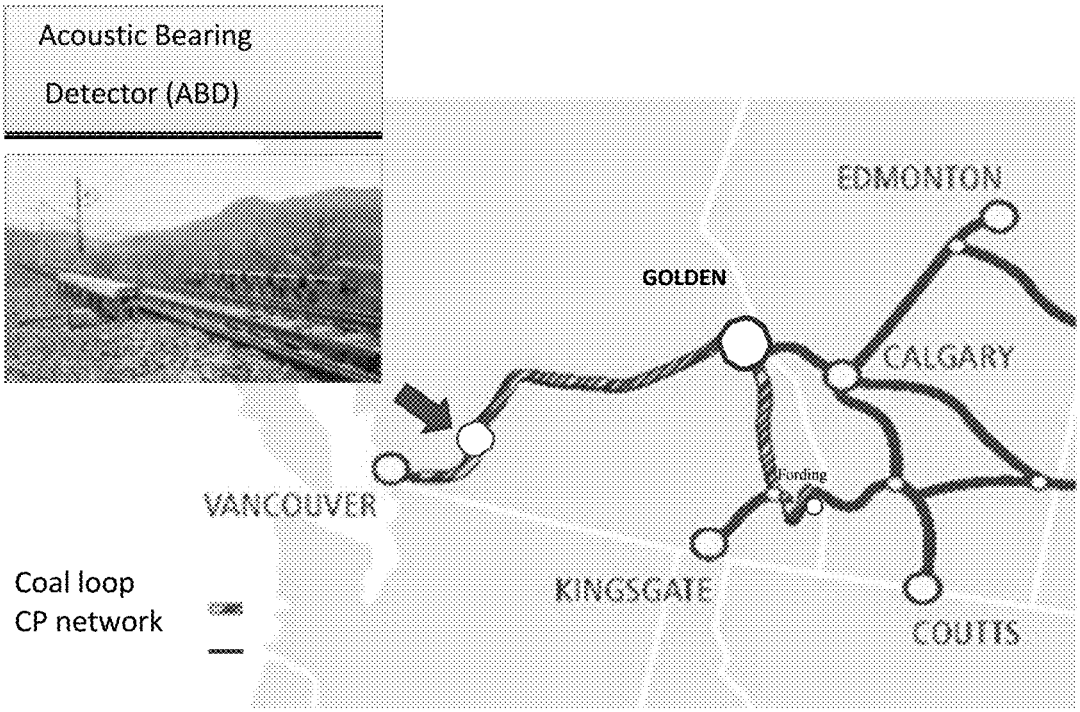

FIG. 9 (Map 1) is an illustration of the CP captive coal loop indicating the location of an Acoustic Bearing Detector (ABD) measuring all railcars on the loaded west-bound movement.

Warm Bearing Temperature Trending

Warm bearing temperature trending has been adopted by the majority of the North American Class I railroads by integrating HBD detector data from large scale HBD detector networks into databases. The data gathered in these wheel temperature sensed event databases have enabled railroads to compare readings between sequential subsets of HBDs and identify upward trends in roller bearing temperatures (Pinney & Cakdi, 2015). Contrasting with the initial one strike implementation of HBDs of early implementations that simply issued a radio warning to the train crew if a hot bearing was detected (Cummings & Tournay, 2003), more recent warm bearing trending sensors and systems operates at much lower temperatures providing increased operational flexibility and safety due to multi-hit designs.

CP generates three (3) types of warm bearing trending alerts based on sequential HBD detector data as shown in Chart 1.

The CP warm bearing trending rules include conditions which verify all identified bearings against the Association for American Railroads ("AAR") standard S-6001 (AAR. 2015) for Why Made codes ("WM") 51 and 52. These rules are designed to identify warm bearing outliers within a train as compared to all of the bearing peers. More complex rules have been developed at CP in an effort to increase the ratio of verified versus non-verified bearing faults after MD-11 teardown inspections are performed. Results from 2015 show 86% of all bearing removals based on the augmented CP rules are verified with MD-11 equipment defects compared to an industry average in 2014 of 65% (Pinney & Cakdi, 2015). However, the benefits of such an increase in defect identification accuracy are offset by an increased number of required railcar setoffs and associated service interruptions that are experienced in response to HBD trending alerts alone.

FIG. 7 (Chart 1) illustrates the Absolute 5, Delta 3, and Delta 5 warm bearing trending algorithms.

Acoustic Bearing Detection Technology

There are two (2) main vendors of ABD technology with products presently in operation on Class I North American freight railways. CP uses the Track-side Acoustic Detection System (TADS) developed by the Transportation Technology Centre Inc. ("TTCI") and distributed by Voestalpine SIGNALING USA Inc. to measure all bearings in the loaded coal movements described in the CP Captive Coal Fleet Example.

The TADS uses a microphone array to record sound emitting from passing train movements. Each microphone in the array is supported along the wayside at the height of the roller bearings in passing trains. (Ngigi, et al., 2012). The system uses inductive rail sensors to measure the axle timing, speed, and direction of the movements. Using these parameters, the acoustic signature for each wheelset is segregated and then signatures from each microphone in the array are consolidated using digital signal processing techniques. The time-frequency map of each aggregated time signal for each wheelset is then calculated. Bearing defects affect both the frequency and amplitude of the patterns which appear in calculated time-frequency visualization maps. Using machine learning classification techniques and reference databases, changes in the time-frequency harmonics are associated to specific bearing defects (Kankar, et al., 2011). The TADS currently outputs six (6) defect types with an associated severity ranging from 1 (less severe) to 5 (most severe) for each type. These defects are identified with alerts which reference specific internal components of the bearings namely the: cup, cone, and roller. Additional alerts are also included when a specific component cannot be isolated by the classification algorithm: for example, multiple and growler types of signals. The growler alert is the most severe indication alerted by the TADS. Time-frequency map examples of a good bearing (a) and a bearing with a growler defect (b) are shown in Graph 1. Note the changes in peak harmonics and the generation of additional peak changes in the affected bearing acoustic signature.

Figure 10:
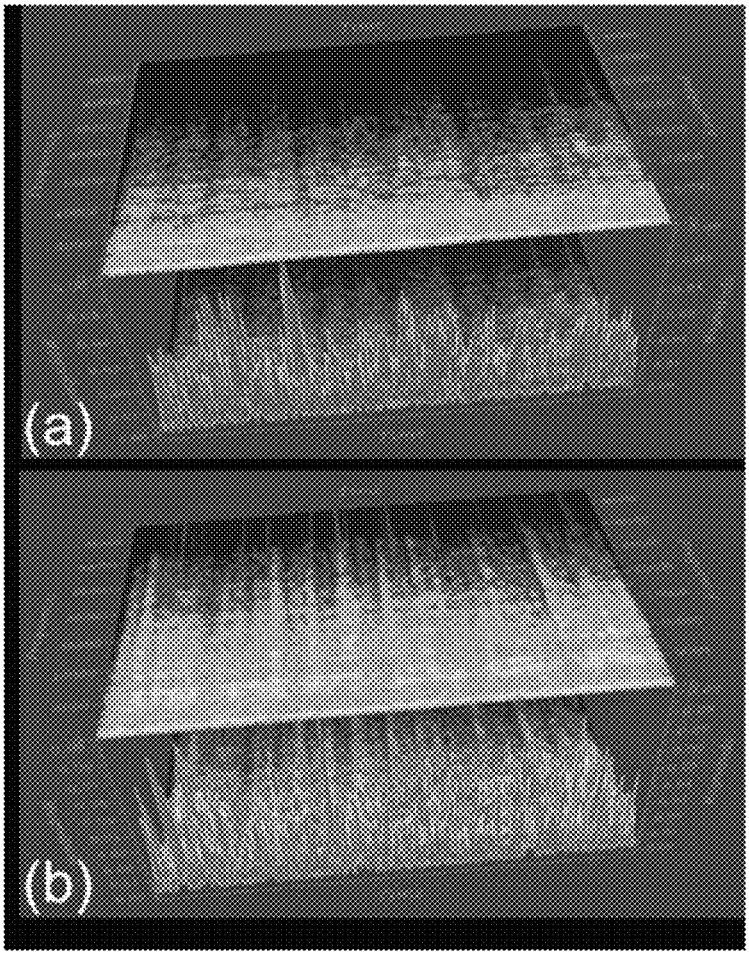

FIG. 10 (Graph 1) illustrates time-frequency maps for a good bearing (a) and a bearing with a growler defect (b).

Correlating Warm Bearing Trending Failures Using TADS Growler Alert Type Signals The approach of this invention aims to use early detection capabilities of ABD technology (as sensed with TADS type sensors) to predict the occurrence of impending future CP augmented warm bearing trending alerts. The goal of the analysis is to prevent railcar setoffs resulting from bearing failures identified by warm bearing trending alerts while reducing the need to over-maintain the railcar fleet due to the sensitivity of ABD technology and TADS sensors. This approach focuses on early sensor detection of gradual bearing failures which by definition are representative of warm bearing trending failure processes.

To verify this correlation analysis system, setoffs from 21 coal railcars with warm bearing trending alerts and at least 1 growler alert were extracted from historical databases from a prior 6 month period. A total of 151 growler alerts correspond to the 21 particular identified related railcar assets. The 21 cases split 60/40 for model development and testing respectively. For 13 cases used for development, the number of days between the last measured growler and a warm bearing trending alert were calculated. The mean of the number of days then was taken across all cases with the same number of growler alerts, to define a mean time to failure (MTTF) in units of days. As an example, the days before failure for all railcars with 3 growler alerts are calculated and then averaged to determine the MTTF based on a growler count of 3. This is represented by Eq. 1 with MTTF for growler count (N), days to failure for each railcar (n) with the same growler count (Dn), and the total number of railcars with the same growler count.

$$MTTF_N = \frac{1}{M}\sum_{n=1}^{M} D_n \qquad \text{Equation 1}$$

Correlating Indications Predicting Service TTF with Acoustic Growler Alert Count Since Renewed or New TTF in days was calculated for different growler counts found in all 13 development cases. The results are plotted in Chart 3. An exponential trend line was then fitted to the plotted curve. Using the equation of the fitted curve (Eq. 2), a TTF of the other 8 test cases was derived and validated. Observing the curve however shows that some points fall below the fit. In these situations, a few actual failures occur prior to the associated predicted failure. Therefore, the model equation was adjusted to compensate for these outliers by inserting a TTF safety factor (Eq. 3). Although most cases may result in a TTF above (longer than) the calculated predictions of the system, expected consequences of service interruptions resulting from earlier-than-predicted failures of the outliers will significantly affect the derived benefit of the system. Furthermore, all growler alert removals, even in the event of a single alert, are AAR condemnable defects. Consequently, in the event that model predictions that do not result in complete use of the bearings before actual failure the result is that their replacement is mandated in accordance with AAR interchange rules. The associated benefits of eliminating service interruptions and performing maintenance on the empty cycle of the railcar assets demonstrably far outweigh the consequential additional maintenance costs and provides a means for managing the sensitive ABD alerts which otherwise have been problematic in terms of false or too early indications of impending bearing failures.

$$\text{MTTF}=100.08e^{-0.135(\#\ growlers)} \qquad \text{Equation 2}$$

Figure 11:
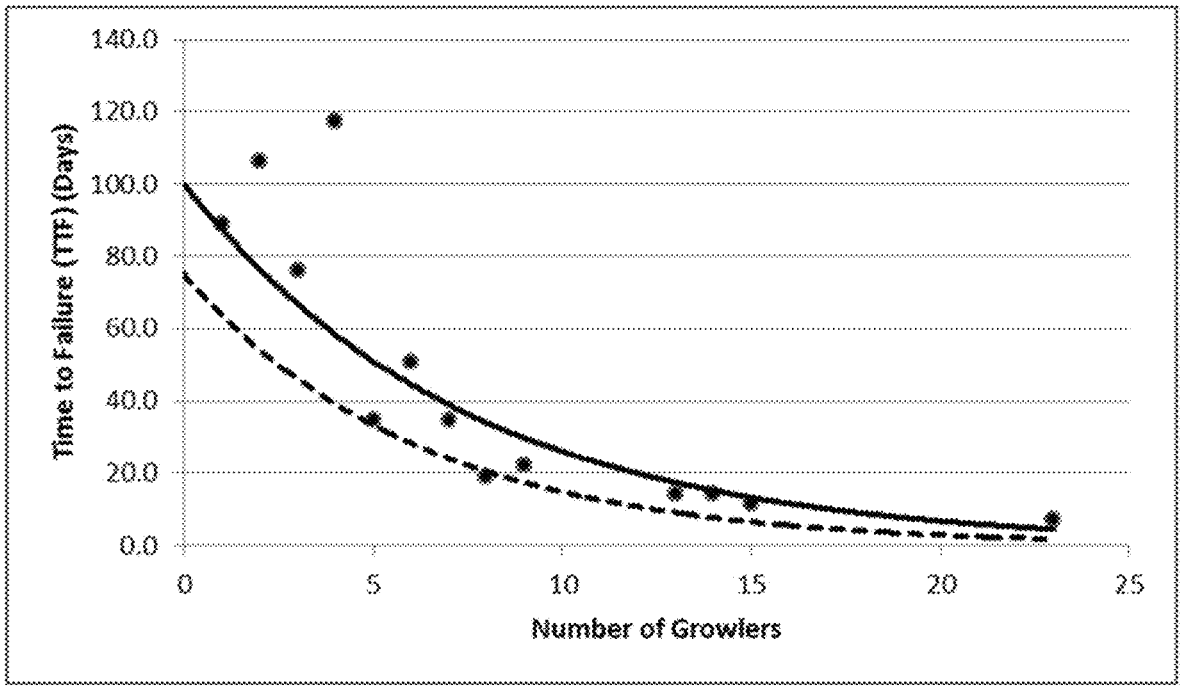

FIG. 11 (Chart 3) illustrates an empirical relationship between the acoustic growler alert count and Mean Time to Failure (MTTF) for bearings (•) with exponential curve (-) Eq. 2 and safety factor (---) Eq. 3 curve fits.

$$\text{MTTF}_{safety\ factor}=75e^{-0.163(\#\ growlers)} \qquad \text{Equation 3}$$

Validation of the Mean Days to Failure Predictions Based on Test Cases

To validate the model, a TTF safety factor in days was calculated using Eq. 3 for each of the 8 verification test cases based on the historical acoustic growler count for each asset or wheelset. The results were then compared to the actual failure date which is the date when a warm bearing trending alert triggered for the same wheelset as shown in Table 3.

TABLE 3

Results of the MTTF in days for all test cases based on the number of growlers against a railcar asset.

| Test Case | # of Growlers | Predicted MTTF (days) | Actual MTTF (days) | Service Interruption Avoided (Y/N) |
|---|---|---|---|---|
| 1 | 2 | 54.1 | 108.5 | Y |
| 2 | 4 | 59.1 | 117.3 | Y |
| 3 | 6 | 28.2 | 50.9 | Y |
| 4 | 7 | 24.0 | 34.7 | Y |
| 5 | 8 | 20.4 | 25.7 | Y |
| 6 | 9 | 17.3 | 17.4 | Y |
| 7 | 13 | 9.0 | 14.2 | Y |
| 8 | 14 | 7.7 | 14.2 | Y |

The predicted TTF in all cases shows less than the actual TTF. This means that a service interruption caused by a warm bearing trending alarm is prevented in 100% of cases while utilizing the assets well beyond what is otherwise indicated by the ABD data from TADS, alone.

Reducing Predictive Error by Converting Days to Failure to Trip Cycles

Predicting failures down to the calendar day is impractical for a field implementation like the closed-loop CP coal route. Performing proactive maintenance by field personnel based on calendar day is difficult to manage in mechanical facilities, and days or "time" alone is not exactly relevant to bearing life. In the case of the continuous looping nature of the CP coal fleet, such accuracy is not required. The predicted TTF can be converted into a cycle time approach. By understanding that a coal train completes a round trip cycle time on average in 5 days, the TTF model was converted into a cycle-based model by dividing the results by the train cycle time and predicting in terms of remaining trips as opposed to calendar days. This way, field maintenance systems can place an alert on assets with one trip remaining and field personnel can have those assets switched out to a suitable mechanical repair facility on an empty cycle (upon return to Golden yard). The results are shown in Table 2. Note trips may be truncated because a partial trip failure results in a service interruption.

TABLE 4

Results of the predicted TTF in trips for all test cases based on the number of growlers against a railcar asset.

| Test Case | # of Growlers | Predicted TTF (trips) | Actual TTF (trips) | Service Interruption Avoided (Y/N) |
|---|---|---|---|---|
| 1 | 2 | 10 | 21 | Y |
| 2 | 4 | 7 | 23 | Y |
| 3 | 6 | 5 | 10 | Y |
| 4 | 7 | 4 | 6 | Y |
| 5 | 8 | 4 | 5 | Y |
| 6 | 9 | 3 | 3 | Y |
| 7 | 13 | 1 | 2 | Y |
| 8 | 14 | 1 | 2 | Y |

MD-11 Post Bearing Teardown Results

During the analysis, when a warm bearing was identified in the field by HBD, the complete wheelset was shipped to the CP test department in Winnipeg, MB. Bearings were removed from the axle ends, disassembled, and visually assessed for failure progression modes ("FPM"). The failure progression modes include: spalling, mechanical, water etch, and bearing destroyed. All results are reported to the industry (AAR) in the form of an MD-11 report.

Of the 8 validation test bearings, 5 were received and processed by the lab. Details on each bearing are provided in Table 3 including an association between the growler count for each bearing and the maximum measured temperatures which triggered the warm bearing temperature trends setoff. Visual inspection of all of the removed bearings suggested spalling as the principle FPM and thus the cause of the failure. Detailed report descriptions also suggest: thick grease, inboard cup path spalls, out-board cup path discoloration, inboard roller spalling, and additional raceway spalls. In all 5 cases (100%) the bearings are verified with AAR condemnable defects.

TABLE 5

MD-II teardown results showing 5 of the 8 model test cases and indicating the growler count, maximum temperature measurements which triggered the warm bearing trend, and the principle failure progression mode causing the failure.

| Test Case | # of Growlers | Maximum temperature (° F.) | FPM |
|---|---|---|---|
| 1 | 2 | 81 | SP-Spalled |
| 3 | 6 | 92 | SP-Spalled |
| 4 | 7 | 96 | SP-Spalled |
| 6 | 9 | 123 | SP-Spalled |
| 7 | 13 | 127 | SP-Spalled |

The teardown results confirm that bearings removed based on this system's information were defective bearings with a likelihood of experiencing a failure in-service. The maximum temperatures shown in Table 5 also suggest a relationship between growler count and the severity of the warm bearing trend triggering temperature. A review of the detailed descriptions of the bearing teardown inspections revealed major spalling on both the rollers and raceways in addition to cage damage for the two bearings with the highest growler counts and temperatures in Table 5. In contrast, for the 3 bearings with lower growler counts and lower temperatures in Table 5, only minor spalling in the raceways and 33% less spalling in the rollers was observed. This further confirms the high sensitivity of ABD detection systems and supports ABD growler alerts as valid predictors of the bearing failure processes' progression.

We note that when an HBD bearing alert identifies a car for removal, the railcar asset is no longer loadable until the affected wheelset which contains the affected bearing is replaced. Railcar owners are responsible for payment for the wheelset removal and its repair in addition to additional railcar switching and movements (manipulations), and loss of use.

This system may allow the car owners to save paying train delay and over the road repair costs. In turn, overall the railroad, customer, and car owner may all benefit from: on-time delivery, avoided train delay, challenges of repairing assets in nature, and avoiding the delay of other car shipments on the same train.

If the railcar is removed from service based on an overload, imbalance, improper waybill (car is travelling empty or loaded but paperwork says otherwise), which may be indicated by WILD sensor data, tariffs may be applied for shipping non-compliance and assets may be removed from service until the defect is rectified. These alerts are possible by analysis of sensor data from WILD detectors. Overly or improperly loaded railcars affect bearing life and increase the risk of failure and may cause damage to railways. WILD alerts are useful to mitigate increased equipment wear which may affect service or costs.

To identify false alarms caused by, for instance, interference from sun radiation or other temperature-affecting causes (debris, ice, snow, clouds, rain, moisture), CP developed an automated scan profile ("DSR") recognition system for network bearing and wheel temperature detectors (i.e. HBDs) which is applied to all scan profiles from HBD sensors to validate the sensed temperature prior to triggering. The system uses a 'dictionary' database of both valid and invalid profiles as a benchmark for comparison with collected sensor signals. Correlation of the received scan profiles from sensor with respect to all wheels and bearings of passing trains against a defined threshold profile helps determine the validity of the measured temperatures. The detector processing algorithms of the prior art merely select the highest observed temperature from all scan sample points. If an alerting sensor signal is considered invalid, no trend point (failure record) is produced. Therefore, derived distances to failure (TTF) remain unaffected by false positives when building models.

Failure predictive information characteristics and derived travel distance to failure can be adjusted based upon continuous operation of the system adjusting the fitting equation (e.g. Equation 2) and TTF safety factor (e.g. Equation 3), for instance, adaptive to new sensor data and railcar data. Furthermore, as suggested above, additional data sources can be analyzed to improve the derived distances as well. This does not change or alter the base invention or idea.

Discussion and Conclusions

TTF system results have shown that in all test cases warm bearing trending alerts with severities requiring immediate over-the-road setoffs are preventable in the CP coal fleet. Post MD-11 teardown inspections show that 100% of the 5 processed bearings are verified with actual failure progression modes. Spalling is associated as the main cause of failure in all cases. A comparison between the growler alert count and the associated maximum warm bearing triggering temperatures confirms increasing severity in triggering temperatures is associated with increased growler count and also confirms the validity of using growler alerts as progressive bearing failure predictors. Furthermore, correlating increases in visible defects with increases in measured temperatures at failure provides additional insight into the causes of heat signatures and relates these signatures to critical stages in the bearing failure process, and with ABD and other sensor information.

Consolidating both the development and test cases, a set of rules based on growler count were implemented in a basic rules engine. This has been done at CP as part of the Equipment Health Monitoring System ("EHMS"). During a sample period, only a single warm bearing trending alert was triggered over a 4 month period. This is in contrast to a monthly historical average of 3 warm bearing trending alerts (derived using 2016 historical exception data). The result of use of the system in practice has been a 91% decrease in bearing related service interruptions equating to over $30K USD in cost avoidance in the coal fleet alone during that 4 month period based on associated train delay costs of $2500.00 USD per hour and an average time to setoff and resume of 1 hour. The consolidation of the development and test cases is shown in Table 6, which has been implemented in CP's EHMS systems. As an additional safety factor, railcars are removed from service for maintenance when 2 trips are predicted to be remaining. At CP a Bad Order when Empty (BOE) alert flag is currently placed against the affected assets in the car maintenance system. These alerts inform operations that the assets must be switched out to the mechanical car department for repair once emptied. It is important to note also that Bad Order Count has not increased for bearings based on predictive BOE alerts. This further demonstrates that the model is not creating unnecessary fluctuations in labour requirements and that predicting and preventing warm bearing trending alerts is not leading to increased asset maintenance. The early visibility provided by ABD alerts is therefore being taken advantage of only when necessary. This has allowed current mechanical labour requirements to remain the same.

This system applies to the CP coal fleet but can be expanded to additional fleets which follow a similar looping nature, and may over time with sufficient data for generalizable analysis be capable of use in larger, less homogenous rail or transport settings and multi-railway networks. An example may be found in high priority transcontinental intermodal trains. Preliminary analysis indicates a similar trend when compared to the trend experienced in the CP Captive Coal Circuit experiment. In order to increase the number of acoustic measurements on additional fleets, CP installed an additional TADS system in 2016 and plans to install 2 additional systems in 2017 to capture different fleet and traffic types. Further measures to reduce warm bearing trending alarm occurrences have been implemented such that bearing replacements for assets with open acoustic alerts on repair tracks are performed opportunistically. This process may provide a benchmark for using ABD data to predict warm bearing trending failures and can be used by other rail operators in doing evaluation for their equipment.

In future work with the coal fleet, the scan profiles of the HBDs, known as Dynamic Scan Ratios ("DSRs") will be assessed when a hot bearing or a warm bearing trending alert occurs. In some cases, parasitic heat sources, such as the sun, can bias scanner results and trigger false alerts. The HBDs CP uses measure 48 data points to compile a scan profile. However, only the peak of the profile is reported by the HBD sensor as the bearing temperature. The current process at CP and in the industry is to stop the affected train based on the peak measured temperature and inspect and/or setout the railcar assets for bearing replacements. These biased measurements or false positives can be identified and filtered out, such that unnecessary service interruptions and maintenance actions are avoided. Decreasing reporting false events will also increase the accuracy of the TTF predictions of the larger system of this invention due to increased robustness in the data used to find failure precursors.

TABLE 6

Results of the MTTF in trips based upon consolidating both development and test cases.

| # of Growlers | MTTF in trips before warm bearing trending alert |
|---|---|
| 1 | |
| 2 | |
| 3 | |
| 4 | |
| 5 | |
| 6 | |
| 7 | |
| 8 | |
| 9 | |
| 10 | |
| 11 | |
| ≥12 | BOE |

Additional opportunities exist to incorporate additional data into the model when outliers occur.

TABLE 7

TABLE OF REFERENCES

AAR, 2015. Manual of Standards and Recommended Practices - Section F/G, s.l.: Association of American Railroads.

Anderson, G. B., 2003. TD-03-009: Roller Bearing Inspections Based on Acoustic Detector Removals, s.l.: Transportation Technology Centre Inc. (TTCI).

Cummings, S. & Tournay, H., 2003. TD-03-028: Sophisticated Alarming Potential of Hot Box Detectors, s.l.: Transportation Technology Centre Inc. (TTCI).

Kankar, P. K., Sharma, S. C. & Harsha, S. P., 2011. Fault diagnosis of ball bearings using machine learning methods. Expert Systems with Applications, 38(3), pp. 1876-1886.

Ngigi, R. W., Pislaru, C., Ball, A. & Gu, F., 2012. Modern techniques for condition monitoring of railway vehicle dynamics. Journal of Physics: Conference Series, 364(1), pp. 1-12.

Pinney, C. & Cakdi, D., 2015. MD-11 Statistics - Failure Progression Mode (FPM) Analysis, s.l.: Transportation Technology Center Inc. (TTCI).

Shives, T. R. & Willard, W. A., 1977. MFPG Detection, Diagnosis and Prognosis. Chicago, Il, Proceedings of the 26th Meeting of the Mechanical Failures Prevention Group.

Walker, R., Cline, J., Smith, E. & Dasher, J., 2007. TD-07-024: Acoustic Bearing Detectors and Bearing Failures, s.l.: Transportation Technology Centre Inc. (TTCI).

GLOSSARY

"CP" means Canadian Pacific Railway Company, including its subsidiaries and affiliates "WILD" means Wheel Impact Load Detector "HBD" means Hot Box Detector "TADS" means Trackside Acoustic Detector System "WPD" means Wheel Profile Detector "BTD" means Bearing Temperature Detector "WTD" means Wheel Temperature Detector "KIPS" means 1000 lbs. force "consist" means the set of locomotives and railcars which are placed in sequence to create a train "AEI" means Automated Equipment Identification "truck" means components of railcars which support the body, frame, and load. Truck also encapsulate the wheelsets, bearings, and braking systems "growler" means alert produced by an ABD indicative of a bearing failure potential "TTF" means Time To Failure, and can be expressed in units which are meaningful or relevant to the cause of a failure event, and which are also useful or relevant to railcar movement and expected location(s) before a failure event occurs; examples may be "days" in a closed loop travel circuit with regular car movements, or "distance" from a sensed event measurement "operator of a railcar" in the Claims includes a person or entity with an operational role with respect to a railroad, railcar, train or rail-transport-related equipment (e.g. multi-modal systems including a rail component), Class I railways, short-line railways, car owners, maintenance providers, logistics information providers, and operators of railways subject to Association of America Railway Interchange or similar Rules

I claim:

1. A system to provide alarm information to an operator of a railcar, the system including sensor apparatus comprising at least one of:

(a) a temperature sensor or Hot Box Detector ("HBD") aimed at the space through which a wheel of a railcar will pass while traversing a segment of the rail of a railway with which the temperature sensor is associated, to detect, measure/record the temperature of the wheel via a HBD-Wheel Temperature Detector ("HBD-WTD") or the bearings for the wheel via a HBD-Bearing Temperature Detector ("HBD-BTD") at a spot from which the temperature of the bearings for the wheel may be easily inferred or determined, as the wheel passes by the space;

(b) an array of strain gauge type sensors called a Wheel Impact Load Detector ("WILD") along a segment of rail of a railway to measure wheel impact and load as a railcar's wheels traverse the segment of railway;

(c) a Wheel Profile Detector ("WPD") sensor, comprising:

(i) a laser or similar controlled energy source;

(ii) a camera or similar energy detector;

(iii) in a mounting device for attachment next to a rail of a railway and aimed to illuminate and capture profile details of wheels passing by the device on the rail;

(d) an acoustic bearing detector or Trackside Acoustic Detector System ("TADS"), comprising:

a microphone or vibration sensor pack operatively attached to or near a rail of a railway, to capture or detect and measure or record vibration or sound made by each wheel of a railcar passing by the device on the rail;

with the sensor operatively communicating with-associated timing, electronics and storage or transmission apparatus to collect the measurements acquired by the sensors in a format useful for analysis;

(e) information receipt, storage and manipulation means to receive information from the sensor means ('sensor information') about a wheel passing the sensor means (a 'sensed event') including sensed information, sensor location or identification information from which location may be inferred, and sensed event timing information for each sensed event;

(f) means to organize and correlate the sensor information and associate relevant parts of the sensor information with a particular wheel or railcar at the particular time and location of each sensed event;

(g) means to organize the sensor information associated with a particular wheel or railcar over time ('particularized sensor information over time'), and to provide both statistical (mathematically derived) and graphical representations of that organized sensor information;

(h) means to determine, whether preset by the operator or the operator's policies, or by cross-referencing particularized sensor information over time against proven or deemed failure of the relevant wheel, that a subset of the particularized sensor information associated with proven or deemed failure of a relevant wheel is an indication of an incipient or imminent failure (a "failure precursor") and may include information about imminence of predicted failure;

(i) means to identify a particular element or elements of the particularized sensor information over time which are different from other elements of the particularized sensor information over time; and (j) means to provide the operator with information, which may be an alert, that a particular wheel of a particular railcar is anomalous, and that the anomaly, being the difference in sensor information identified at step i) correlates meaningfully with the indication of step h) of a failure precursor, indicating that a particular maintenance or operational action is recommended, and may include in the failure precursor operator information an indication of remaining serviceable life of the particular wheel before incipient predicted failure.

2. The system of claim 1 where the identification of each wheel with a particular railcar's axle and side is done by correlating the measurement and sensor location information with other information which may include any of: information about railway, railcar, train and consist, movement and scheduling, load, logistics, availability of maintenance or other services, billing, ownership, lading or other railcar or manifest, consist or ownership or operatorship information.

3. The system of claim 1 where, IF the particularized sensor information over time or frequency is:

(a) from acoustic bearing sensor TADS information which indicates internal or external defects of individual railcar wheel roller bearing component such as, but not limited to: the bearing, cup, cone, roller, and cage; where the defects can include, but are not limited to: spalling, mechanical, water etch, bearing destroyed, and is a failure precursor, THEN the operator information or alert to the operator may be given opportunistically to schedule maintenance of the defects indicated to railcars already sent to a shop for maintenance or which can be scheduled at a next available maintenance facility in the railcar's routing;

(b) from acoustic bearing sensor TADS information which indicates internal and external individual railcar wheel roller bearing component defects such as, but not limited to: spalling, brinelling, and/or water etch, which are indicative of progressive internal defects known to lead to or predictive of high temperature failures, and is a failure precursor—THEN the operator information or alert is predictive and is used to schedule maintenance of the defective component by mechanical shops to perform proactive repairs at a convenient facility and time in the railcar's routing;

(c) from infrared temperature sensor HBD information and indicates internal and external individual railcar wheel roller bearing component defects such as, but not limited to: spalling, brinelling, mechanical, bearing destroyed and/or water etch, which are indicative of urgent internal defects and may be predictive of incipient complete bearing failure, and is a failure precursor, THEN the operator information or alert to the operator indicates that the affected railcar's wheel roller bearing is immediately failing and the train must cease movement for inspection and handling whether scheduled or not and that this type of information or alert may be the type of particularized sensor information over time which comprises a failure precursor of step f) of claim 1;

(d) from multiple infrared temperature sensor detectors HBDs and indicates internal and external individual railcar wheel roller bearing component defects such as, but not limited to: spalling, brinelling, mechanical, bearing destroyed, and/or water etch, which are indicative of urgent internal defects and progressing bearing failure, and is a failure precursor, THEN the operator information or alert to the operator is predictive that the affected railcar roller bearing is progressively failing and is used to schedule maintenance of the defective component by mechanical shops to perform proactive repairs at a convenient facility and time in the railcar's routing and that this must be handled at nearest mechanical accessible location;

(e) from infrared temperature sensor HBD information which indicates airbrake system component defects such as, but not limited to: brake beam, brake cylinder, brake side frame liner, brake rigging, brake control valve, or hand brake applied, which are indicative of railcar inoperative brake systems both from cold and hot sensed wheels, and is a failure precursor, THEN the operator information and alert to the operator is that the affected railcar wheel is experiencing excessive temperatures and the train must cease movement for inspection and handling whether scheduled or not and that this type of information or alert may be the type of particularized sensor information over time which comprises a failure precursor of step f) of claim 1;

(f) from infrared temperature sensor HBD information across multiple HBC detection systems and indicates airbrake system component defects such as, but not limited to: brake beam, brake cylinder, brake side frame liner, brake rigging, brake control valve or hand brake applied, which are indicative of railcar inoperative brake systems both from cold and hot sensed wheels, and is a failure precursor, THEN the operator information or alert to the operator may include that the affected railcar wheel is experiencing excessive temperatures and the train must apply and release airbrakes to minimize excessive temperatures;

(g) from WILD strain based sensor information and indicates a weight in pounds or kilograms or balance difference or ratio (%) between wheels of a railcar, and is a failure precursor, THEN the operator information or alert to the operator may be that the railcar's load is off-balance and should be re-balanced or, that surcharges, rerouting or other services or actions may be appropriate;

(h) from WILD strain based sensor information and indicates a load/empty difference or ratio (%) between train documentation and actual railcar contents, and is a failure precursor, THEN the operator information or alert to the operator is that the car's load is improperly documented or loaded, an undocumented load change has taken effect and the car and load should be reviewed at a next opportunity, and appropriate corrective activities and potential charges, documentation changes and similar actions should take place;

(i) from WILD strain based sensor information and indicates a wheel defect based on measured impact forces (KIPS or 1000 lbs-force) such as, but not limited to: shelling, out of round, or tread build-up, and is a failure precursor—THEN the operator information or alert to the operator is that the railcar's wheel may be condemnable and must be replaced at a next or convenient time and location depending upon the severity of the defect indicated; or (j) from a WPD optical sensor information and indicates a wheel defect in inches or millimeters such as, but not limited to: thin or high flange, hollow tread, thin rim, out of gauge, or other feature sized between x-y coordinates in inches and millimeters of the measured profiles, and is a failure precursor, THEN the operator information or alert to the operator may be that the railcar's wheel is condemnable and must be replaced at a next or convenient time and location depending upon the severity of the defect indicated.

4. The system of claim 1 where the sensor location information, the railcar's route, and sensed event information is combined to determine or infer other information which is operator information and which is relevant to determination of a predicted term of use of the associated railcar and location or range until failure of the equipment predicted by the failure precursor, such as distance traveled by the railcar's wheel; in particular:

(a) In railway operations utilizing the railcar which are a fixed circuit, a single sensor location may be sufficient to determine relevant information such as distance travelled by the railcar's wheel, although it may be preferable to utilize multiple sensor locations;

(b) In railway operations utilizing the railcar over routes which are not a fixed circuit, a multiplicity of sensor locations will be required, and the co-ordination of sensor, railcar, train consist and routing and load information from a variety of different railway and train operations or even operators may also be required in order that failure precursor and relevant operator information and alerts may be provided by the system.

5. The system of claim 1 wherein the quality of sensor information is improved by statistically analyzing waveforms of the information provided by a sensor which includes information about sensed events, and discarding sensor information the waveform of which is not statistically representative of true sensed events.

6. The system of claim 5 wherein the sensor information collected from HBD sensors may in particular be susceptible to sending information appearing to be from sensed events, or which may be triggered by a sensed event, but the information sent may be degraded or distorted by extraneous influences such as sunlight on a housing of a temperature sensor; and the sensor information is improved by statistically analyzing a large number of sensed event information elements to derive an expected waveform profile of good information from sensed events, information about particular sensed events which is anomalous in comparison to the derived expected waveforms is flagged and causes the flagged sensed event information to be treated differently in order to signal a required manual review of the information, or to signal the initiation of a process to apply a factor to the weighting of the anomalous sensed event for use in operation of the system's other subsystems.

7. The system of claim 1 which is adjusted during operation, particularly by comparing inspection and repair information from repair facilities and activities against the failure precursor information, to continuously improve the system's operation.

8. The system of claim 7 wherein additional data source used to generate better failure precursor information; or statistical analysis of many pieces of particularized sensor information over time or frequency from a large variety of sensors and sensor types about a large variety of railcars, loads, wheels and related sensed equipment are used to generate meaningful multi-variate or combined sensed event information which together may form failure precursor or similar predictive information for the operator.

9. The system of claim 1, where the failure precursor subset of information may be sensed events information from a variety of sensor types and may be from a variety of sensor locations.

10. The system of claim 1 wherein the alarm information is used together with an indicator to an alarm recipient of a consequential action, which may include a maintenance or logistic scheduling event, a charge to a railcar or load owner or operator, or an order or warning that the railcar will become unserviceable or should be removed from service prior to the expiry of the derived and alarmed proximity.

* * * * *